US005232058A

United States Patent [19]

Morin et al.

[11] Patent Number: 5,232,058

[45] Date of Patent: Aug. 3, 1993

[54] EQUIPMENT FOR A DRILLING FITTING COMPRISING AN ELEMENT TO BE ACTUATED, A MOTOR AND CONTROL MEANS

[75] Inventors: Pierre Morin, Levallois Perret; Christian Bardin, Rueil Malmaison; Jean Boulet, Paris, all of France

[73] Assignee: Institut Francais Du Petrole, Rueil-Malmaison, France

[21] Appl. No.: 459,281

[22] Filed: Dec. 29, 1989

[30] Foreign Application Priority Data

Dec. 30, 1988 [FR] France ..... 88 17599

[51] Int. Cl.[5] ..... E21B 7/08

[52] U.S. Cl. ..... 175/73; 175/74; 175/76; 175/107; 175/325.2

[58] Field of Search ..... 175/61, 73, 74, 75, 175/76, 325, 107

[56] References Cited

U.S. PATENT DOCUMENTS

| | | | |
|---|---|---|---|
| 4,040,494 | 8/1977 | Kellner | 175/61 X |
| 4,185,704 | 1/1980 | Nixon, Jr. | 175/76 |
| 4,281,723 | 8/1981 | Edmond et al. | 175/61 X |
| 4,286,676 | 9/1981 | Nguyen et al. | 175/74 |
| 4,305,474 | 12/1981 | Farris et al. | 175/76 X |
| 4,694,914 | 9/1987 | Obrecht | 175/61 |
| 4,739,842 | 4/1988 | Kruger et al. | 175/76 X |
| 4,817,740 | 4/1989 | Beimgraben | 175/76 X |
| 4,848,488 | 7/1989 | Cendre et al. | 175/61 |
| 4,854,397 | 8/1989 | Warren et al. | 175/61 X |
| 4,909,336 | 3/1990 | Brown et al. | 175/61 X |

FOREIGN PATENT DOCUMENTS

| | | | |
|---|---|---|---|
| 251543 | 1/1988 | European Pat. Off. | 175/76 |
| 8703329 | 6/1987 | PCT Int'l Appl. | 175/61 |

*Primary Examiner*—Hoang C. Dang

*Attorney, Agent, or Firm*—Antonelli, Terry, Stout & Kraus

[57] ABSTRACT

Drilling fitting equipment is disclosed, comprising a drilling motor, a member to be actuated, an information detection unit and a power unit for controlling the member, the motor comprises an energy transformation zone for rotating a drilling tool, the zone having an upper end, the equipment comprising a flow of drilling fluid through the drilling fitting, wherein the member to be actuated and at least one of the elements of an assembly formed by the detection unit and the power unit are situated on opposite sides of the upper end.

13 Claims, 10 Drawing Sheets

EQUIPMENT FOR A DRILLING FITTING COMPRISING AN ELEMENT TO BE ACTUATED, A MOTOR AND CONTROL MEANS

BACKGROUND OF THE INVENTION

The present invention relates to equipment for a drilling fitting possibly with controlled trajectory and the fitting itself.

This equipment is intended to be placed on a fitting, itself intended to be placed at the end of a drill-string. This fitting makes it possible to control the variations of direction and inclination of the drilling in real time. Furthermore, it allows the azimuth, and the radius of curvature to be controlled accurately and the friction phenomena to be reduced and the risks of jamming to be limited without requiring said fitting being raised to the surface.

SUMMARY OF THE INVENTION

Drilling fitting equipment in accordance with the present invention comprises a drilling motor, a member to be actuated, information detection means and power means for controlling this member. The motor comprises an energy transformation zone for rotating a drilling tool, this zone has an upper end. The drilling equipment comprises a circuit for the flow of drilling fluid through the drilling fitting. In accordance with the present invention, the member to be actuated and at least one of the elements of the assembly formed by the detection means and the power means are situated on each side of said upper end. The detection means are adapted to detect information transmitted by the drilling fluid. The power means and the member are connected mechanically together, i.e. the transfer of movement between the power means and the member takes place mechanically and not hydraulically.

The two elements of this assembly may be situated on the same side relatively to the upper end.

The member to be actuated and the drilling tool may be situated on the same side relatively to the upper end.

The detection means may be adapted for detecting at least one of the following quantities, a speed of rotation such as the speed of rotation of the rotor of the motor, a mechanical stress such as a stress related to the weight applied to the drilling tool, a fluid pressure, a fluid flowrate and a predetermined sequence concerning one or more of the above mentioned values.

The power means may take the energy required for the control of the member to be actuated from a fluid flow.

The power means may be situated on a side opposite the member to be actuated relatively to the upper end. A transmission element, more particularly mechanical, then transmits the movement for actuating the member on each side of the upper end.

The transmission element may also serve as body for the drilling motor.

The transmission element may transmit a moment of rotation.

The power means may comprise a shaft transforming an axial movement into a rotational movement.

The transmission element in accordance with the present invention may comprise information transmission means for transmitting a signal when the member to be actuated has been effectively actuated.

The member to be actuated may be a variable angle elbow element situated between the energy transformation zone and the drilling tool or a variable geometry stabilizer situated between said upper end and the drilling tool.

The member to be actuated may be integrated in the mine motor.

The detection member and the power means may be integrated in the motor.

The fitting in accordance with the present invention comprises a drilling tool placed at the lower end of said fitting, a motor for driving said tool in rotation as well as at least one variable geometry stabilizer.

The fitting of the present invention may comprise another stabilizer and/or an elbow element.

The elbow element may be with fixed angle or variable angle. The elbow element may be integrated with said motor.

The variable geometry stabilizer may comprise means adapted for varying the distance between the axis of said fitting and the bearing surface of at least one blade of the stabilizer and/or means adapted for varying at least axially the position of the bearing surface of at least one blade of said stabilizer.

The fitting of the present invention may comprise at least one stabilizer which is interlocked for rotation with said tool.

The fitting of the present invention may comprise at least one stabilizer fast for rotation with the body of the motor.

The variable geometry stabilizer or stabilizers may be remote controlled if required from the surface.

The fitting of the present invention may comprise a variable geometry stabilizer as well as two other stabilizers placed on each side of said variable geometry stabilizer. The elbow element may be integrated with said motor.

Of course, the fitting of the present invention may provide control of the azimuth (of the direction of the drill hole), which may be facilitated by means of an elbow element integrated in the downhole motor, no rotation being applied to the drill-string from the surface.

Control of the radius of curvature is facilitated by the association of an elbow and a stabilizer.

By elbow element is meant a member introducing or able to introduce locally, if not at a point, a discontinuity in the direction of the axis of the drillstring. That is to say that the axis of the drilling fitting is a crooked line at the level of the elbow element.

BRIEF DESCRIPTION OF THE DRAWINGS

The present invention will be better understood and its advantages will be clear from the following description of particular examples which are in now wise limitative and which are illustrated by the accompanying figures, in which.

DESCRIPTION OF THE PREFERRED EMBODIMENTS

Figure 1:
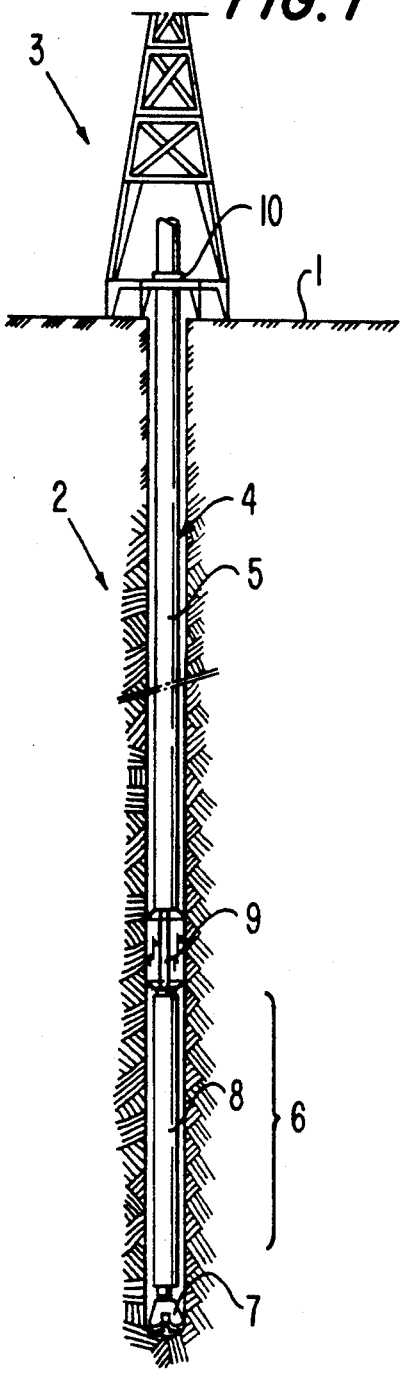
FIG. 1 shows a drilling fitting.

In the embodiment shown in FIG. 1, the reference 1 designates the surface of the ground from which a well 2 is drilled. Reference 3 designates the surface installation as a whole.

The drilling equipment 4 comprises a drill-string 5 to the end of which is fixed a drilling fitting 6.

The drilling fitting 6 corresponds to the lower end of the drilling equipment and may be considered as forming part of the drill-string.

A drilling fitting generally has a length of a few tens of meters, the thirty meters or so the nearest to the drilling tool is generally considered as active in so far as the control of the trajectory is concerned.

In the embodiment of FIG. 1, the drilling fitting comprises a drilling tool 7, a downhole motor 8, and a variable geometry stabilizer 9.

In this embodiment, the drilling tool 7 may be rotated by the downhole motor 8, or by the drill-string 5 which may be driven from the surface by drive means 10, such as a turntable.

By variable geometry stabilizer is meant, in accordance with the present invention, that it may be adjusted for varying the geometrical configuration of the bearing points of the blades on the walls of the drilled well, this variation being considered for the same position of the fitting in the drilled well.

Figure 2:
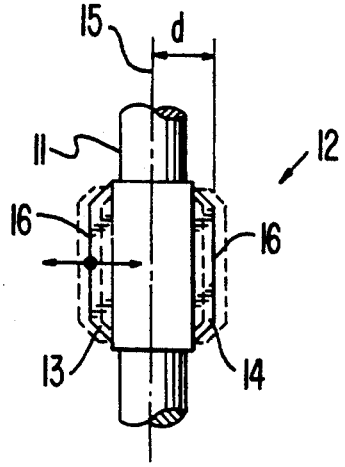
FIGS. 2 to 4 show different types of variable geometry stabilizers.
Figure 3:
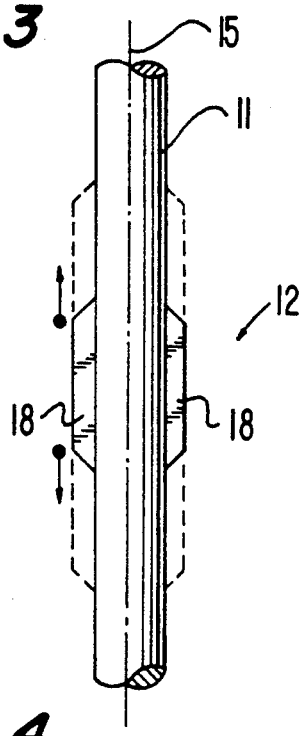
Figure 4:
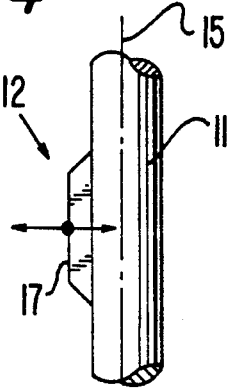

In FIGS. 2 to 4 have been shown different types of variable geometry stabilizers.

Reference 11 designates the drill-string portion which carries the stabilizer 12.

In FIG. 2 the stabilizer comprises several blades of which two are shown: blades 13 and 14.

In this embodiment, the blades may move so as to vary the distance d which separates axis 15 of the drill-string portion 11 from the friction surface 16 of blade 14 or 13.

In FIG. 2, the arrows show the movement of the blades. Possible positions of the blades are shown with broken lines.

FIG. 3 shows a variable geometry stabilizer in which the blades 18 move axially, as shown by the arrows. The broken lines show possible positions of blades 18. FIG. 4 shows the case where there is a single blade 17 which moves. This type of stabilizer is often termed "offset". Of course, the same offset effect of axis 15 is obtained by having several mobile blades placed on the same side of an axial plane containing axis 15, or else by causing the blades situated on the same side of an axial plane containing axis 15 to move more extensively than the blades situated on the other side of the same plane.

Without departing from the scope of the present invention, variable geometry stabilizers may be used of other types than those described above, particularly using blades which combine the different above mentioned movements.

Figure 5:
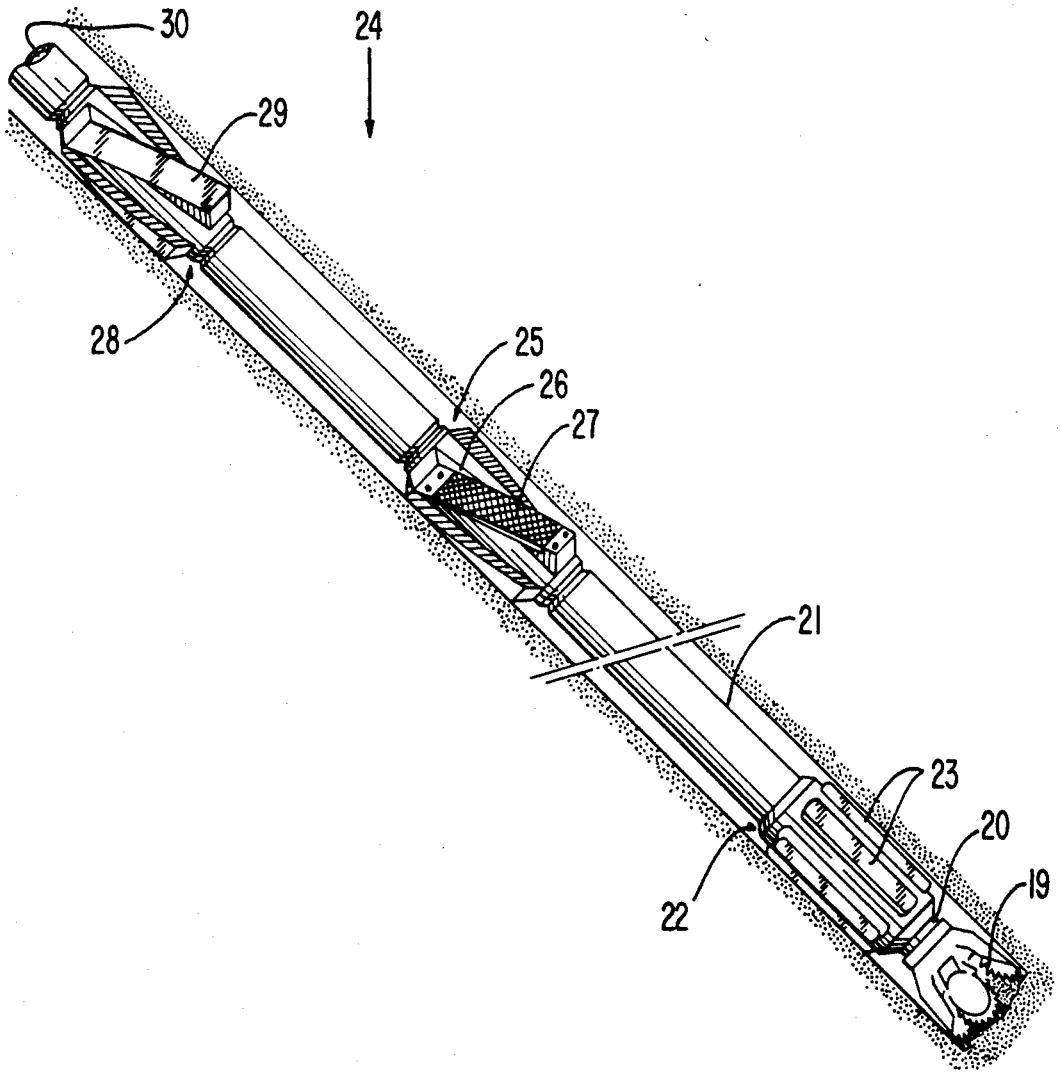
FIG. 5 illustrates a fitting having three stabilizers one at least of which is with variable geometry.

Of course, the blades may have a helical shape, as shown in FIG. 5, particularly for the central stabilizer.

FIG. 5 shows an embodiment which is different from that of FIG. 1.

In this new embodiment, reference 19 designates the drilling tool which is fixed to a shaft 20 driven by motor 21.

Reference 22 designates a fixed geometry stabilizer comprising rectilinear blades 23 parallel to the axis of fitting 24.

Reference 25 designates a variable geometry stabilizer comprising blades 26 with mobile friction or cutting surfaces 27.

In this embodiment, the blades have a helical shape.

The reference 28 designates a fixed geometry stabilizer with helical blade 29.

Motor 21 may be a lobe motor of the "Moineau" type or a turbine fed with drilling fluid from a passage 30 formed in the fitting, this passage being itself fed with drilling fluid from the drill-string which is hollow. After passing through the motor 21, the drilling fluid is directed towards tool 19 for removing the cuttings.

Motor 21 may also be an electric motor fed for example from the surface via a cable.

In FIG. 5, the variable geometry stabilizer 25 is surrounded on each side by fixed geometry stabilizers 22 and 28. This arrangement is advantageous, but in no wise limitative. Similarly, the fitting may comprise several variable geometry stabilizers.

Figure 6:
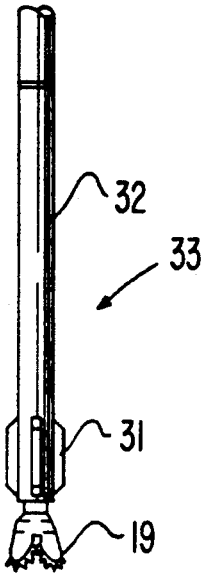
FIGS. 6 and 7 show two variants of arrangement of a stabilizer.
Figure 7:
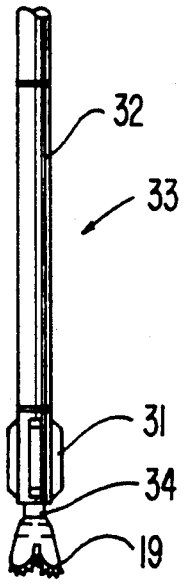

Concerning the lower stabilizer, namely the one which is the closest to tool 19, it may be placed either on the external body 32 of motor 33, as is the case of FIG. 6, or on the shaft 34 rotating tool 19. This is the case of FIG. 7. In these two figures, the stabilizer bears the reference 31.

The fitting of the invention may comprise an elbow element with variable or fixed angle.

Figure 8:
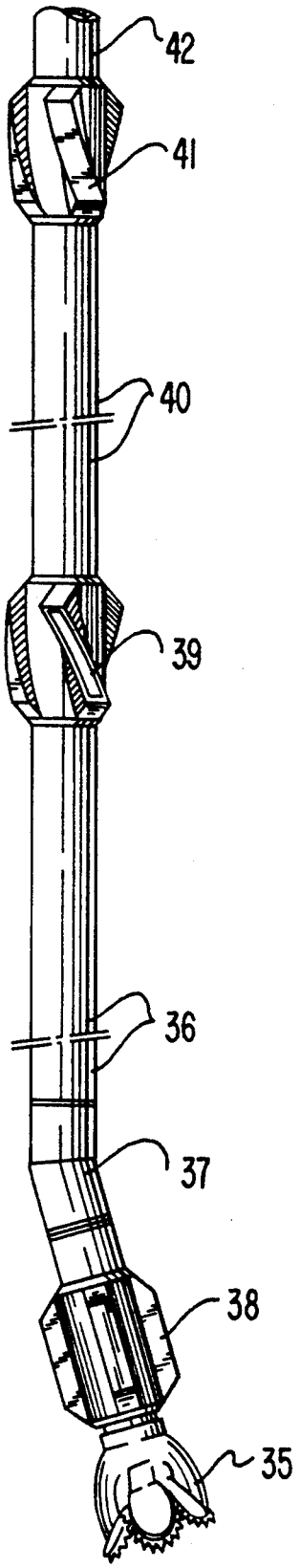
FIG. 8 illustrates a particular embodiment comprising three stabilizers and an elbow element.

FIG. 8 shows such a fitting. This fitting, which performs particularly well, comprises, in so far as its lower part is concerned (approximately the first thirty meters):

- a drilling tool 35 adapted for the ground to be drilled, such as a cone bit, with a cutting element made from polycrystalline diamond or any other synthetic material and which may withstand a rotational speed coherent with the use of a downhole motor. It is necessary to choose a drilling tool with a long useful life.
- a downhole motor (here volumetric) 36 whose body forms an elbow element or elbow 37 in its lower half and is equipped with a stabilizer 38 positioned on the elbowed portion of motor 36, elbow 37 will have an angle preferably less than 3°.

a variable diameter stabilizer 39 which may be remote controlled from the surface.

a drill collar 40 comprising means for measuring, during drilling (MwD) the main directional parameters (inclination, azimuth, tool face) and transmitting them to the surface.

a constant diameter stabilizer 41.

the fitting will then comprise drill collars 42, possibly one or more other stabilizers, heavy drill pipes, a bumper sub, the whole being connected to the surface by a drill-string.

The following figures show examples of a variable geometry stabilizer or variable angle elbow element.

Figure 9A:
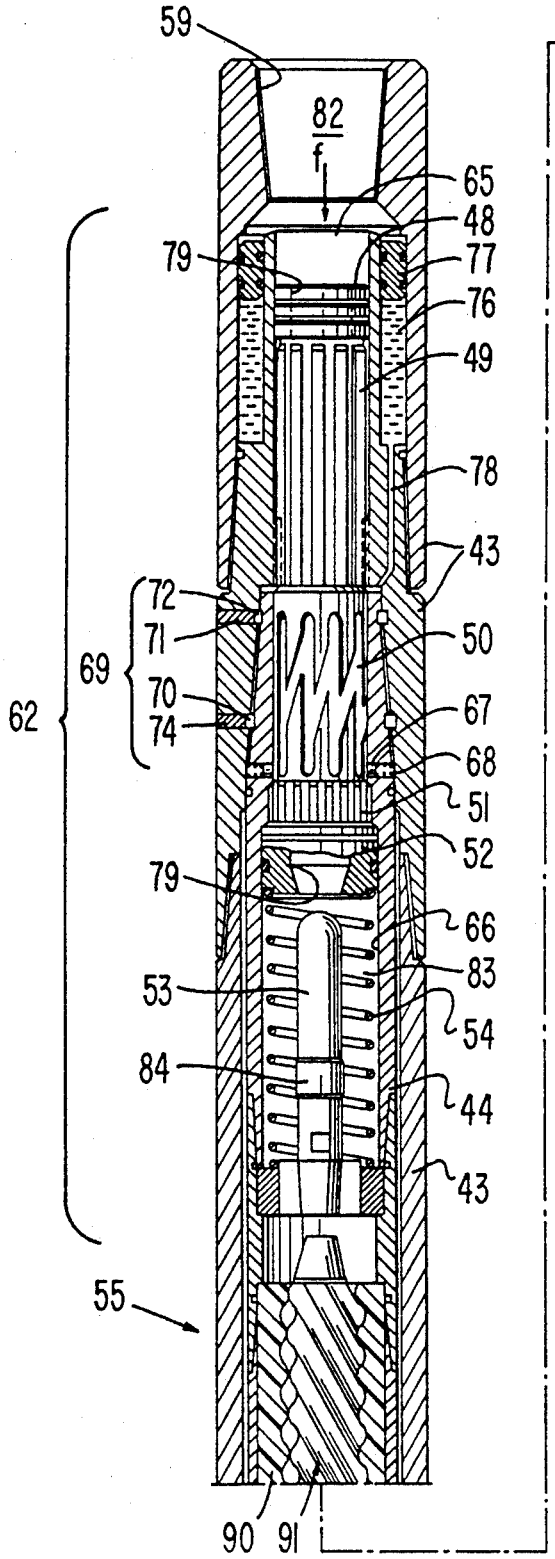
FIGS. 9A and 9B show one embodiment of the present invention in which the angle of an elbow situated at the level of the universal joint of a downhole motor may be varied.
Figure 9B:
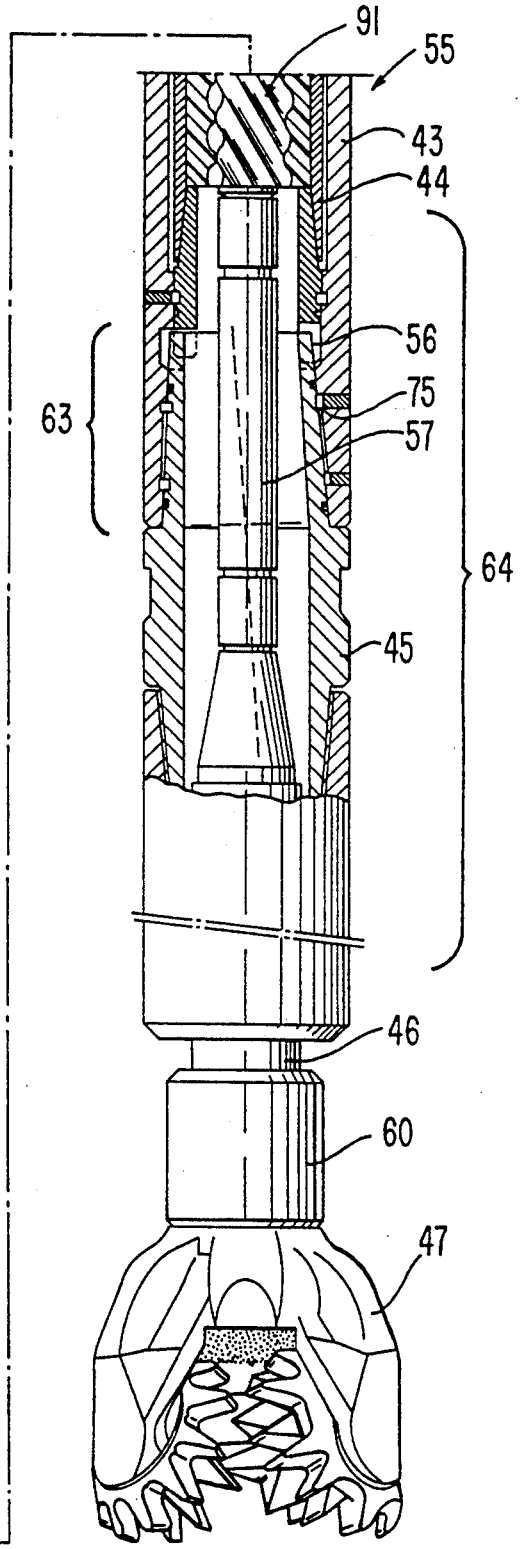
Figure 10:
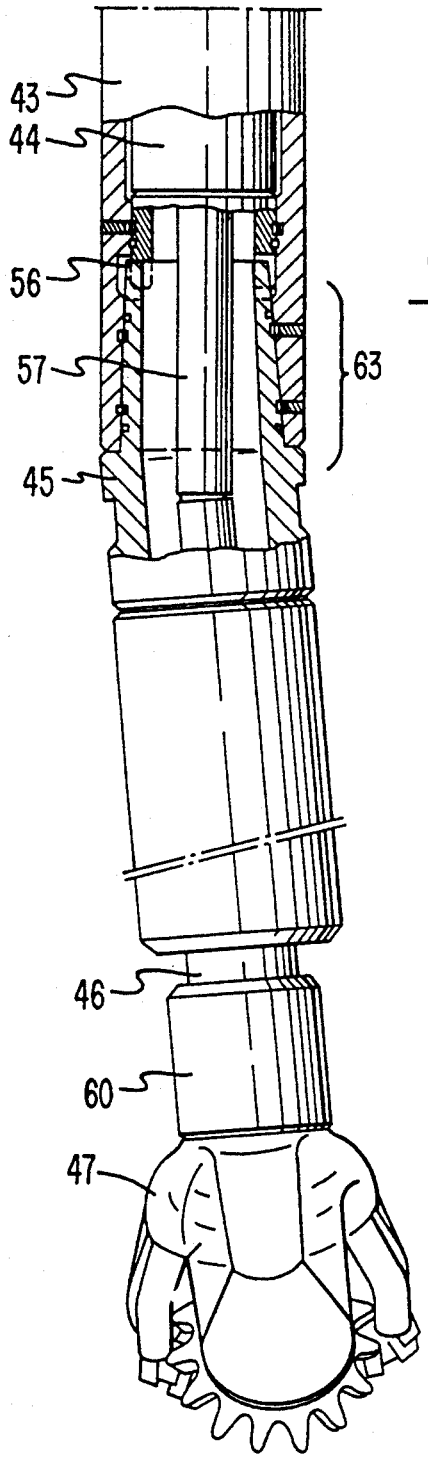
FIG. 10 shows the device of FIG. 9B in a different configuration.

FIGS. 9A, 9B and 10 show a particularly advantageous embodiment of a variable angle elbow element. In this embodiment, a tubular shaped element has in its upper part a threaded portion 59 for mechanical connection to the drilling fitting and in its lower part a threaded portion 60 on the output shaft 46, for screwing on the drilling tool 47.

The main functions are provided:

A. by the downhole motor 55 shown in FIG. 9A in the form of a multilobe volumetric motor of Moineau type, but which may be any type of downhole motor (volumetric or turbine) currently used for land drilling and which will therefore not be described in detail. Reference 91 designates the energy transformation zone of the motor. Reference 90 designates the upper end of this zone.

B. by a remote control mechanism 62 whose purpose is to pick up the change of position information and cause differential rotation of the tubular body 44 relatively to the tubular body 43.

C. by a drive mechanism absorbing the axial and lateral forces and connecting the downhole motor 55 to the output shaft 46, which will not be described here for it is well known to a man skilled in the art, D. by a mechanism for varying the geometry based on the rotation of the tubular body 44. Reference 57 designates a universal joint. This is useful when the motor is of Moineau type and/or when an elbow element 64 is used.

The remote control mechanism is formed of a shaft 48, which may slide by its upper part in bore 65 of body 43 and by its lower part in bore 66 of body 44. This shaft comprises male spline portions 49 engaging in female spline portions of body 43, grooves 50 which are alternately straight (parallel to the axis of the tubular body 43) and oblique (slanted with respect to the axis of the tubular body 43) in which are engaged fingers 67 sliding along an axis perpendicular to the axis of movement of shaft 48 and held in contact with the shaft by springs 68, and male spline portions 51 meshing with female spline portions of body 44 only when the shaft 48 is in the top position.

Shaft 48 is equipped in its low part with a bean 52 facing which is disposed a needle 53 which is coaxial to the movement of shaft 48. A return spring 54 holds the shaft in the top position, spline portions 51 meshing with the equivalent female spline portions of body 44.

Bodies 43 and 44 are free to rotate at the level of the rotating bearing surface 69 coaxial with the axes of bodies 43 and 44 and formed of rows of cylindrical rollers 70 inserted in their running tracks 72 and which can be removed through orifices 74 by removing door 71.

Bean 52 and needle 53 form the means for detecting information, in this case a flowrate threshold. Shaft 48 with its arrangements forms the power means for activating the elbow element 64 via the tubular body 44 which forms a transmission element.

An oil reserve 76 is held at the pressure of the drilling fluid via a free annular piston 77. The oil lubricates the sliding surfaces of shaft 48 via passage 78.

Shaft 48 is machined so that an axial bore 79 allows the drilling fluid to flow in the direction of arrow f.

The angle varying mechanism properly speaking which is the member to be actuated in this example comprises a tubular body 45 which is locked for rotation with tubular body 44 by a coupling 56. The tubular body 45 may rotate with respect to the tubular body 43 at the level of the rotating bearing surface 63 comprising rollers 75 and having an oblique axis with respect to the axes of the tubular bodies 43 and 44.

Figure 11:
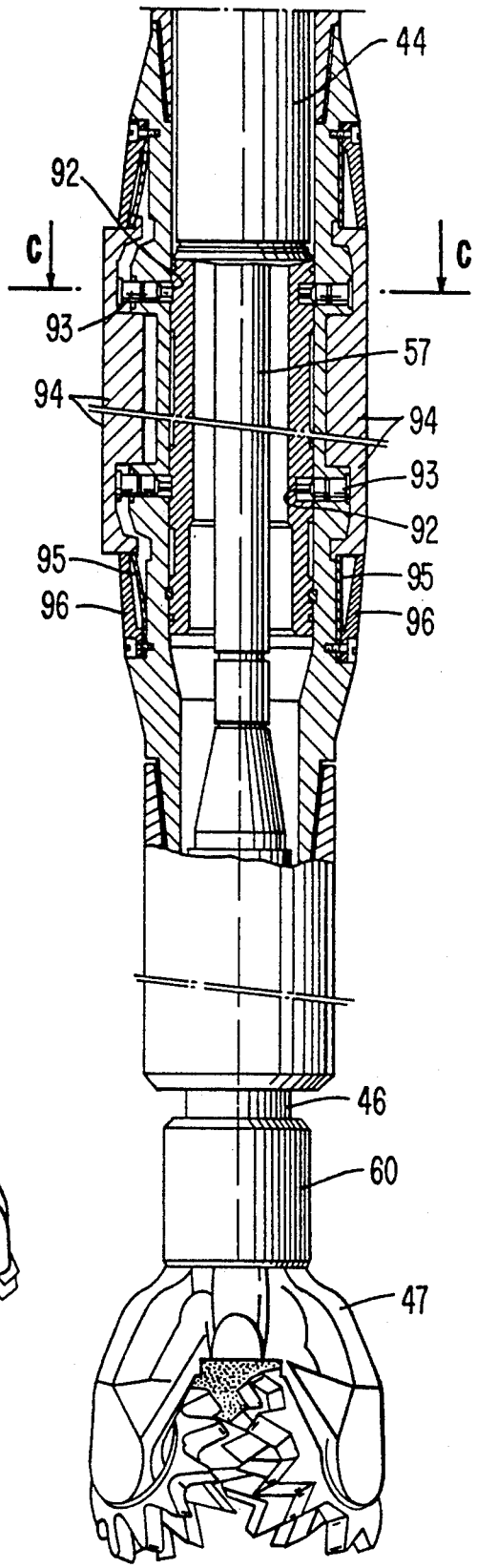
FIG. 11 shows the lower part of a second embodiment of the present invention replacing FIG. 9B, in which the position of one or more blades of a stabilizer may be varied with respect to the main axis of the outer tubular body; this Figure comprises two half sections representing two different positions of the blades of the stabilizer.

One embodiment which may be considered for coupling 56 is shown in FIG. 11.

The operation of the remote control mechanism is described hereafter. This type of remote control is based on a threshold value of the flowrate passing through the mechanism in the direction of arrow f.

When a flowrate Q passes through shaft 48, there occurs a pressure difference $\Delta P$ between the upstream portion 82 and the downstream portion 83 of shaft 6. This pressure difference increases when the flowrate Q increases following a law of variation of the type $\Delta P = kQ^n$, k being a constant and n between 1.5 and 2 depending on the characteristics of the drilling fluid. This pressure difference $\Delta P$ is applied on the section of shaft 48 and creates a force F tending to move shaft 48 in translation downwards while compressing the return spring 54. For a threshold value of the flowrate this force F will become sufficiently high to overcome the return force of the spring and cause a slight translational movement of the shaft. Because of this translational movement, bean 52 will surround needle 53, which will greatly reduce the flow section of the drilling fluid and so greatly increase the pressure difference $\Delta P$ and so cause a great increase of force F causing complete downward movement of this shaft 48, despite the increase in the return force of spring 54 due to its compression.

Because of the machined shape of grooves 50 described in the patent FR-2 432 079, fingers 67 will follow the oblique portion of grooves 50 during the downward stroke of shaft 48 and will therefore cause rotation of tubular body 44 with respect to tubular body 43, which is made possible by the fact that the male spline portions 51 will be disengaged from the corresponding female spline portions of body 44 at the beginning of the downward stroke of shaft 48.

With the shaft in the low abutment position, the fact of cutting off the flow will make it possible for the return spring 54 to push shaft 48 upwards. During this upward travel fingers 67 will follow the rectilinear portions of grooves 50. At the end of the travel, the spline portions 51 will again be engaged so as to interlock the tubular bodies 43 and 44 for rotation.

Figure 13:
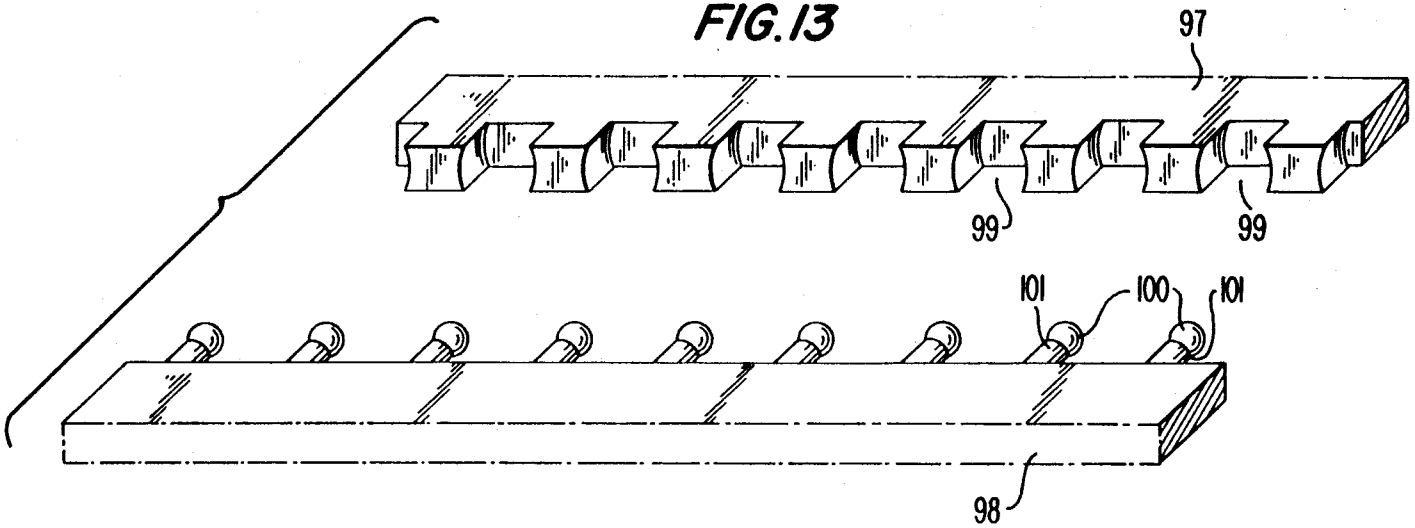
FIG. 13 illustrates a detail of the torque transmission member between two tubular elements while permitting flexion between these two elements, this Figure shows this detail in developed form.

FIG. 13 shows in a developed way the parts 97 and 98 which transmit the rotation of the tubular body 44 to tubular body 45 while permitting a relative angular movement of these two tubular bodies.

In order to transmit information to the surface indicating that shaft 48 has reached its low position, needle 53 may comprise a diameter variation. In the case of FIG. 9A it is an increase of diameter 84. Thus, when the bean arrives at the level of protuberance 84, there is a decrease of the flow section for the fluid which results, for a constant flowrate, in an overpressure in the drilling fluid.

This overpressure can be detected on the surface. The position of protuberances 84 is such that the over pressure only appears when shaft 48 is at the low end of travel.

Part 97 comprises housings 99 in which cooperate rods 100 comprising spheres 101. Thus, although the tubular body integral with part 97 bends relatively to the tubular body integral with part 98, one tubular body drives the other in rotation. Thus, these two parts play the same role as a hollow universal joint.

Variation of the angle is obtained by rotating the tubular body 44 relatively to tubular body 43, which causes, via the drive mechanism 56, rotation of the tubular body 45 with respect to the same tubular body 43. Since this rotation occurs about an axis which is oblique with respect to the two axes of the tubular bodies 43 and 45, it will cause a modification of the angle formed by the axes of bodies 43 and 45. This angle variation is shown in detail in the patent FR-2 432 079. FIG. 10 shows the same part of the device as that shown in FIG. 9B, but in a geometrically different position.

An embodiment will now be described in which the member to be actuated is a variable geometry stabilizer. The remote control mechanism for this stabilizer is the same as that described above.

FIG. 11 shows the mechanism for varying the position of one or more blades of an integrated stabilizer. FIG. 11 may be considered as being the lower part of FIG. 9A.

At the lower end of body 44 are formed grooves 92 whose depth differs as a function of the angular sector concerned. At the bottom of these grooves are applied pushers 93 on which straight or helical blades 94 bear under the effect of blade return springs 95 positioned under protecting covers 96.

The operation of the mechanism varying the position of one or more blades is described below.

When the tubular body 44 rotates with respect to the tubular body 43, caused by the movement of shaft 48, pushers 93 will be situated on a sector of groove 92 whose depth will be different. That will cause a translational movement of the blades, either away from or towards the axis of the body.

FIG. 11 shows on the right hand side a blade in the "retracted" position and on the left a blade in the "extended" position. Several intermediate positions may be envisaged, depending on the angular rotational pitch of the remote controlled rotation mechanism.

Figure 12:
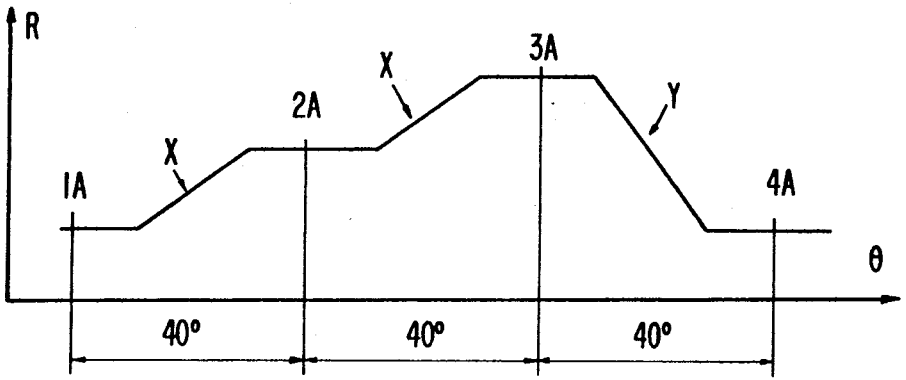
FIG. 12 shows a developed view of a groove bottom profile used in the device of FIG. 11.

FIG. 12 shows the developed curve of the profile of the bottom of groove 92. This profile may correspond, for example, to the case of three blades controlled from the same groove.

The abscissa shows the radius of the bottom of the groove as a function of the angle at the center from an angular reference position. Since the three blades are controlled from the same groove and over a revolution, the profile is reproduced identically every 120°. This is why it has been shown only over 120°. When finger 93 of a blade of the stabilizer cooperates with the portion of the groove bottom profile corresponding to the level portion 1A, this blade is in a retracted position. A rotation through 40° of the groove causes a modification of the radius of the groove bottom from the position corresponding to level portion 1A to that corresponding to level portion 2A and so to an intermediate extended position of the blade. Another rotation through 40° causes an increase of the groove bottom radius corresponding to level portion 3A and to a maximum extension of the blade. Between each level portion a ramp X permits progressive extension of the blade.

Ramp Y is a downgoing ramp which brings the device back to the retracted position corresponding to level portion 4A having the same value as level portion 1A.

A method will now be described for using such a fitting comprising the transmission element in accordance with the present invention and using more particularly the means for driving the drill-string assembly in rotation.

An application of this method is described hereafter, with reference to the fitting shown in FIG. 8.

This fitting is particularly well adapted for drilling a well section, this drilled section comprising:

1. a vertical phase,
2. a beginning of deflection in a given azimuth from 0 to 10 degrees, for example, following a precise trajectory,
3. a rising phase at an angle following a given trajectory (radius of curvature) for example 10 to 30 degrees, 40 degrees, even 50 degrees etc. . . .
4. a possible azimuth correction, during or after the third phase,
5. drilling of a constant angle portion,
6. correction of angle and/or azimuth.

This is made possible by the combination of the angled downhole motor and of the variable diameter stabilizer.

This combination is perfectly used by alternating the drilling periods with rotation of the drilling fitting from the surface with directional drilling periods in which the fitting is held in a given position (tool face). During these two types of period, the radius of curvature of the trajectory of the drilling tool may be modified by varying the geometry (e.g. the diameter) of the stabilizer, in addition to the methods at present available (variation of the weight at the tool, variation of the rotational speed,etc. . . . ).

Figure 14:
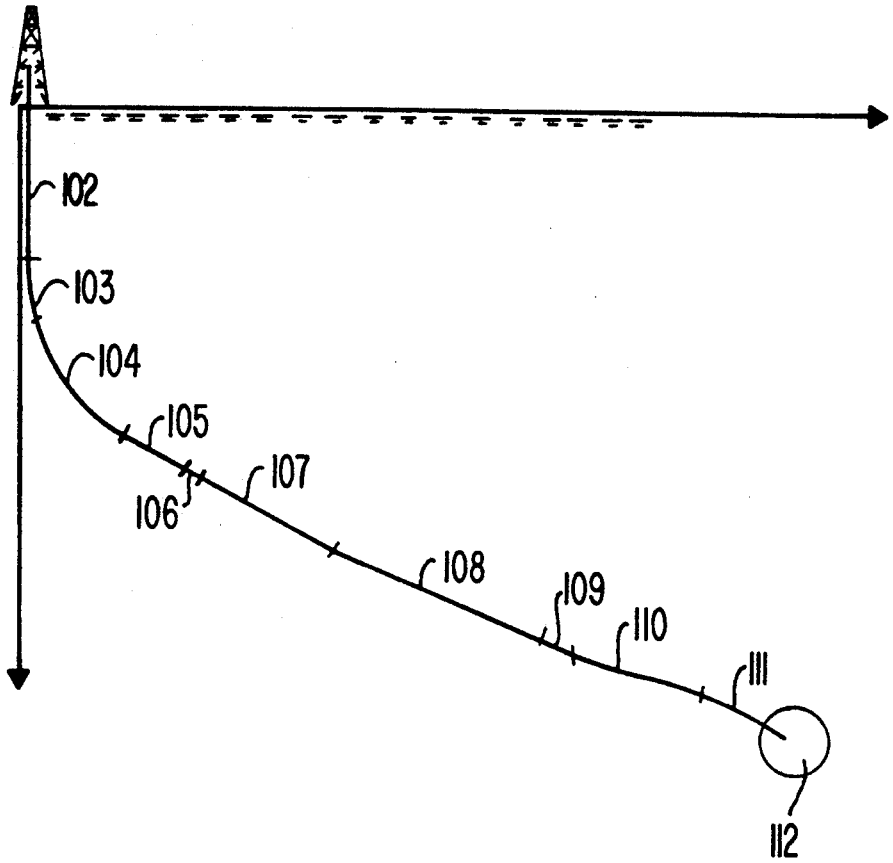
FIGS. 14 and 15 show the trajectory of a drill hole.
Figure 15:
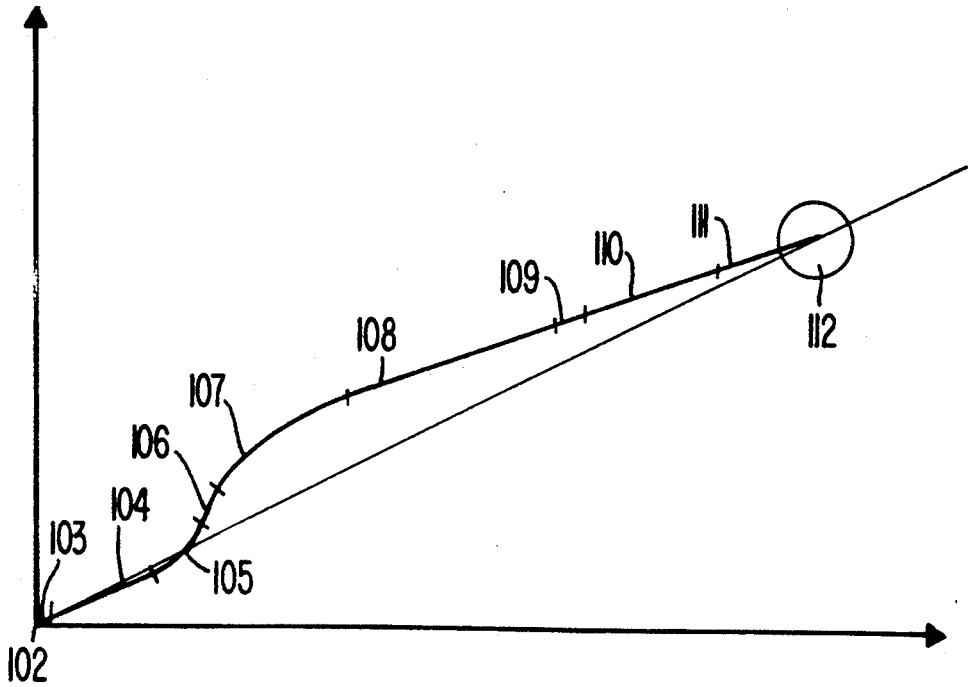

FIG. 14 shows the projection of the trajectory on the vertical plane and FIG. 15 shows the projection of the trajectory on the horizontal plane.

Reference 102 designates the substantially vertical phase of the drilling. This phase is carried out by rotation of the whole of the fitting from the drillstring. The diameter of the variable geometry stabilizer 39 is preferably equal to the diameter of the upper fixed geometry stabilizer 41.

Reference 103 designates the beginning of the deflection from 0 to about 10 degrees which is obtained by orienting the elbow 37 in the desired azimuth of the drillhole followed by rotation of tool 35 by the downhole motor 36, without the whole of the drilling fitting being driven by the drill-string. The radius of curvature of the well may be adjusted by varying the diameter of the variable geometry stabilizer 39. Thus, for example, for an inclination less than 5 degrees, the radius of curvature increases when the diameter of the stabilizer increases. This tendency is reversed for larger inclinations.

Reference 104 designates the rising phase at an angle of about 10 degrees until the desired inclination is reached, without acting on the direction of the well. This phase is obtained by causing the fitting to rotate as a whole from the drill-string. The radius of curvature is adjusted by the diameter of the variable geometry stabilizer 39.

Reference 105 designates a phase for correcting the azimuth which may take place with or without angle correction. In the case of FIGS. 14 and 15, there is no angle correction. This azimuth correction is effected by orienting the elbow element in the appropriate direction so as to arrive at the desired orientation correction and driving the tool by the downhole motor, without the whole of the fitting being driven by the drill-string.

The choice of the diameter of the variable geometry stabilizer 39 makes it possible to control the radius of curvature of the trajectory.

Reference 106 designates a phase of drilling at a constant inclination without controlling the azimuth. This drilling phase may be achieved by rotating the whole of the drilling fitting from the drill-string.

The phase referenced 107 is an azimuth correction phase of the same type as that described above and which bears the reference 105.

The phases referenced 108 and 110 are drilling phases with constant inclination without azimuth control. They are of the same type as the phase which bears the reference 106.

The phases referenced 109 and 111 are phases for reducing the drift angle.

The above described phases follow each other in time in the order of the numbers of the references assigned thereto, going from 102 to 111.

Reference 112 designates the target to be attained by the drilling.

Of course, for other applications, the succession of the different phases and their type may vary depending on the conditions met with during drilling and the objectives to be reached.

Figures 16, 17, 18:
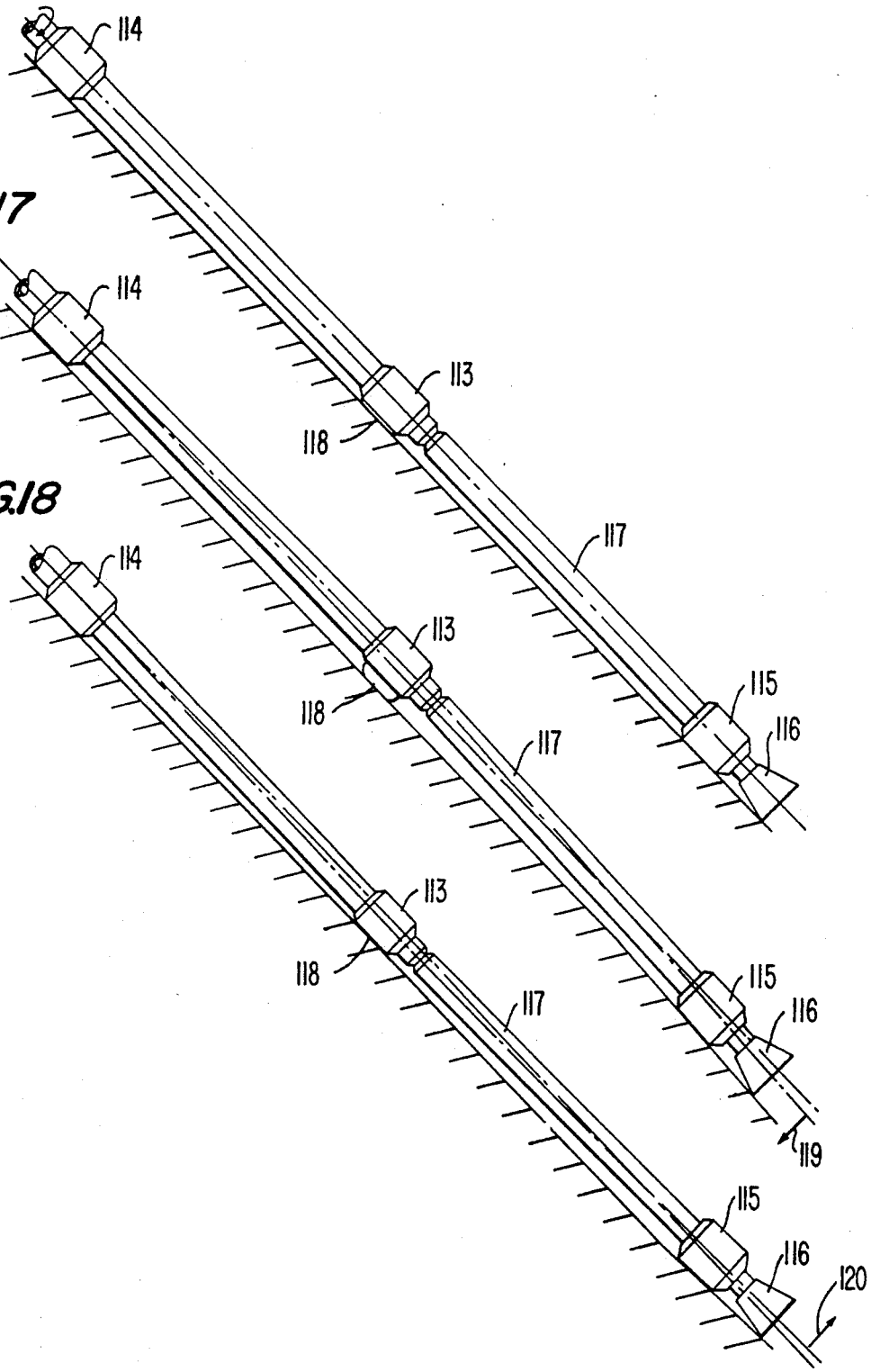
FIGS. 16 to 18 show the way in which the trajectory of a drillhole is controlled in the case of using a fitting with three stabilizers, one of which has variable geometry and a variable angle elbow element.

FIGS. 16 to 18 illustrate the control of the direction of the drillhole by means of a fitting comprising three stabilizers, a variable geometry stabilizer 113 and two fixed geometry stabilizers situated on each side of the variable geometry stabilizer.

The inclination of the drillhole is assumed to be 30 degrees with respect to the vertical. Reference 114 designates the upper fixed geometry stabilizer and reference 115 the lower fixed geometry stabilizer situated near the drilling tool 116. In this example, the fixed stabilizer 115 is fast with the body of the motor 117.

The intermediate position of the blades of stabilizer 113 shown in FIG. 16 corresponds to a drillhole with constant angle of inclination.

The position of the blades 118 of stabilizer 113 shown in FIG. 17 corresponds to a maximum extension thereof, this causes a decrease of the inclination. Tool 116 tends to drill in the direction of arrow 119.

In FIG. 18, the blades of the variable stabilizer 113 are in the maximum retracted position. This corresponds to an increase of the angle of inclination and tool 116 tends to leave in the direction of arrow 120.

Control of the azimuth by a fitting such as the one shown in FIGS. 16 to 18 is possible when it comprises at least one offset stabilizer, whether it is with variable geometry or not.

Figures 19, 20, 21:
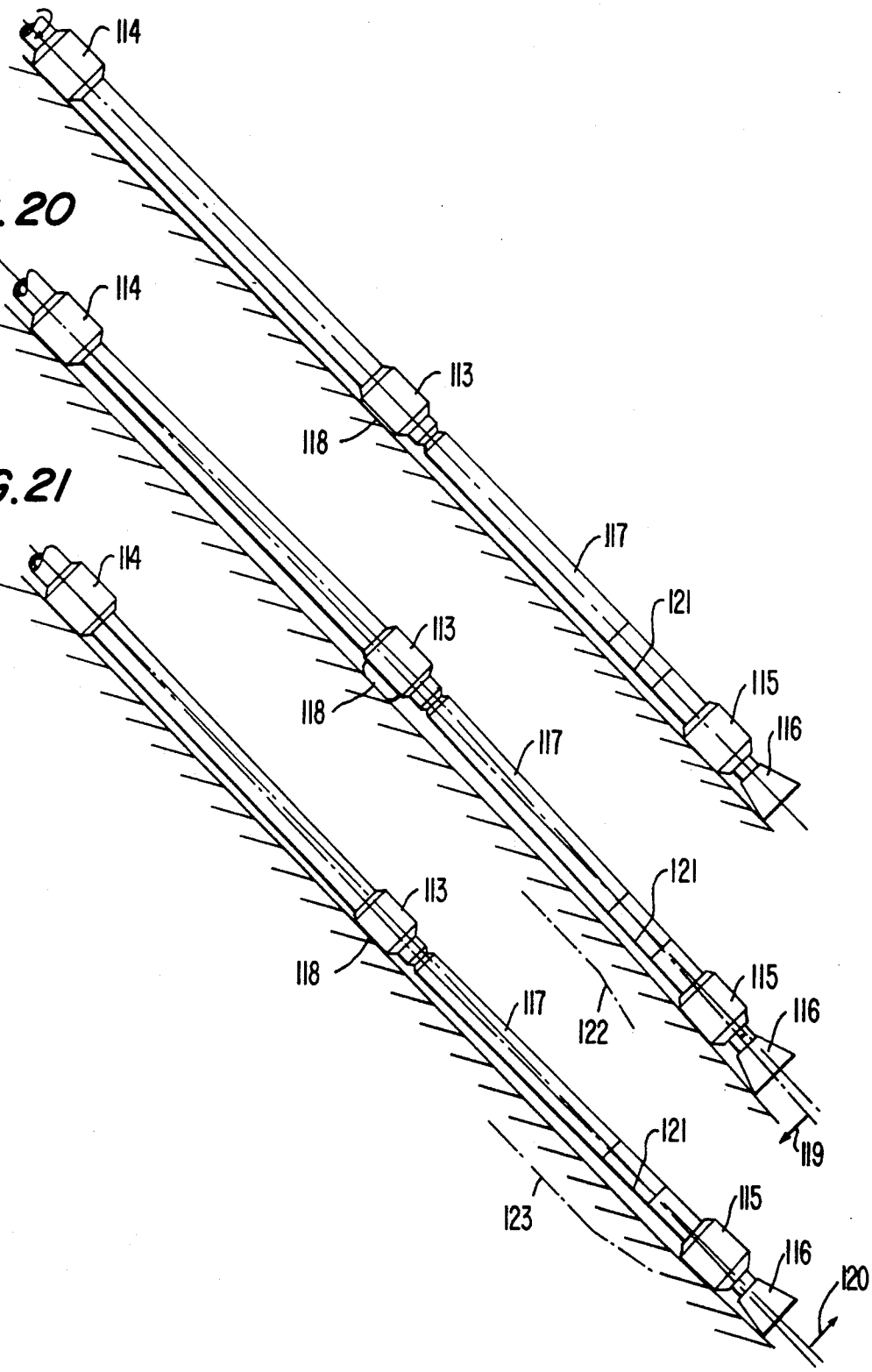
FIGS. 19 to 21 illustrate the same thing in the case where the fitting comprises an elbow element in addition.

FIGS. 19 to 21 correspond to a fitting similar to that of FIGS. 16 to 18 but which in addition comprises an elbow element 121. The elements identical in FIGS. 19 to 21 and 16 to 18 bear identical references.

In this example, elbow 121 is assumed to be with fixed geometry and has a deflection angle close to 1 degree.

In the intermediate position of the blades of stabilizer 113, driving of the whole of the fitting by the drill-string (not shown) causes drilling with constant inclination. In this operating mode, the elbow element 121 only has a very small influence on the behavior of the fitting. In FIG. 20, elbow 121 is positioned so as to orient the drilling downwards of the figure in the direction of arrow 119. This position, shown with a chaindotted line 122, is termed "low side" by the driller.

The angular position of the elbow element 121 is generally checked by conventional measuring means positioned in the drilling fitting. Adjustment of this position is obtained by rotating the drill-string through an appropriate angle from the surface.

In this operating mode, rotation of tool 116 is provided by motor 117.

In FIG. 20, the variable geometry centrer 113 amplifies the reduction of the angle of inclination.

FIG. 21 shows an elbow oriented towards the top position generally termed "high side" by the driller, as shown by the chain dotted line 123.

In this method of adjustment, the angle of inclination of the drillhole increases.

Control and maintenance of the position of elbow 121 is achieved in the same way as explained above.

In the present application, the inclination angle is considered with respect to the vertical direction.

Figure 22:
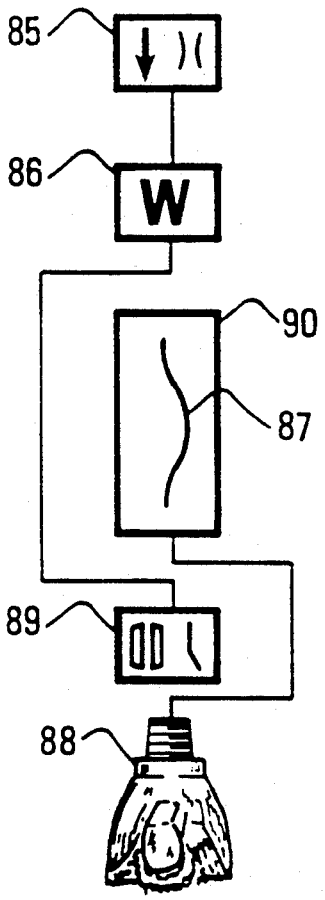
FIGS. 22 and 23 illustrate two variants of arranging the different elements of the equipment in accordance with the present invention.

FIG. 22 shows the case where the member to be actuated 89 is situated on the same side as the drilling tool 88 relatively to the energy transformation zone 87 of the motor, whereas the power means 86 for actuating element 89 are situated on the opposite side.

Reference 90 designates the upper end of the energy transformation zone 87 of the motor.

Reference 85 designates the information detection means. These means may be placed either above the upper end 90 or below, particularly when the information for triggering actuation is transmitted by the weight on the tool.

Figure 23:
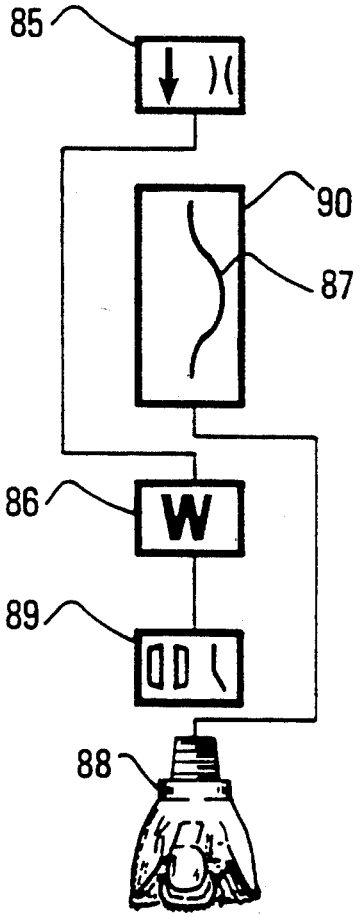

FIG. 23 shows the case where the detection means 85 are situated above the upper end 90 of the energy transformation zone 87 of the motor and where the power means for controlling the actuating member are situated below this upper end 90.

What is claimed is:

1. Drilling fitting equipment comprising a drilling motor, a member to be actuated, information detection means and power means for controlling said member, said motor comprising an energy transformation zone for rotating a drilling tool, said zone having an upper end, means for effecting a flow of drilling fluid through the drilling fitting equipment, wherein said member to be actuated and at least one of the elements of an assembly formed by said detection means and said power means are situated on opposite sides of said upper end, and said detection means detects information transmitted by the drilling fluid; the power means and the member to be actuated being connected mechanically together so that transfer of movement between the power means and member to be actuated takes place mechanically and not hydraulically and said power means takes the energy required for control of the member to be actuated from fluid flow of the drilling fluid.

2. The equipment as claimed in claim 1, wherein the elements of said assembly are situated on the same side relatively to said upper end.

3. The equipment as claimed in claim 1, wherein said member to be actuated and said drilling tool are situated on the same side relatively to said upper end.

4. The equipment as claimed in claim 1, wherein said detection means detects at least one of the following quantities a fluid pressure, a fluid flow rate and a predetermined sequence concerning one or more values of the above mentioned quantities.

5. The equipment as claimed in claim 1, wherein said power means is situated on a side opposite the member to be actuated relatively to the upper end and it comprises an element for transmitting a mechanical movement for actuating the member, on each side of said upper end.

6. The equipment as claimed in claim 5, wherein said transmission element comprises a portion of a body of said drilling motor.

7. The equipment as claimed in one of the claim 5 or claim 7, wherein said transmission element transmits a moment of rotation.

8. The equipment as claimed in claim 1, wherein said power means comprises a shaft transforming an axial movement into a rotational movement.

9. The equipment as claimed in claim 1, comprising information transmitting means adapted for transmitting a signal when the member to be actuated has been effectively actuated.

10. The equipment as claimed in claim 1, wherein said member to be actuated is a variable geometry stabilizer situated between said upper end and said drilling tool.

11. The equipment as claimed in claim 1, wherein said member to be actuated is integrated in said motor.

12. The equipment as claimed in claim 1, wherein said detection means and said power means are integrated in said motor.

13. Drilling fitting equipment comprising a drilling motor, a member to be actuated, information detection means and power means for controlling said member, said motor comprising an energy transformation zone for rotating a drilling tool, said zone having an upper end, means for effecting a flow of drilling fluid through the drilling fitting equipment, wherein said member to be actuated and at least one of elements of an assembly formed by said detection means and said power means are situated on opposite sides of said upper end, and said detection means detects information transmitted by the drilling fluid, the power means and the member to be actuated being connected mechanically together so that transfer of movement between the power means and the member to be actuated takes place mechanically and not hydraulically; said member to be actuated being a variable angle elbow element situated between said energy transformation zone and said drilling tool.

* * * * *